US007290685B2

(12) United States Patent
Yotabun et al.

(10) Patent No.: US 7,290,685 B2
(45) Date of Patent: Nov. 6, 2007

(54) NOZZLE PLATE FOR A SLIDING NOZZLE APPARATUS

(75) Inventors: Tomohiro Yotabun, Gifu (JP); Tsuyoshi Mizuno, Gifu (JP); Tsuyoshi Yoshida, Gifu (JP)

(73) Assignee: Tokyo Yogyo Kabushiki Kaisha, Tokyo (JP)

( * ) Notice: Subject to any disclaimer, the term of this patent is extended or adjusted under 35 U.S.C. 154(b) by 23 days.

(21) Appl. No.: 11/152,209

(22) Filed: Jun. 15, 2005

(65) Prior Publication Data

US 2005/0230886 A1 Oct. 20, 2005

Related U.S. Application Data

(63) Continuation of application No. PCT/JP2004/018749, filed on Dec. 15, 2004.

(30) Foreign Application Priority Data

Dec. 16, 2003 (JP) ..... 2003-418506

(51) Int. Cl.
*B22D 41/30* (2006.01)

(52) U.S. Cl. ..... 222/600; 222/594; 266/236

(58) Field of Classification Search ..... 222/600, 222/594; 266/236
See application file for complete search history.

(56) References Cited

U.S. PATENT DOCUMENTS 6,092,701 A * 7/2000 Waltenspuhl et al. ..... 222/600
6,814,268 B2 * 11/2004 Rothfuss et al. ..... 222/600
2002/0175452 A1 11/2002 Kawarada

FOREIGN PATENT DOCUMENTS

| | | |
|---|---|---|
| JP | 6-61362 | 8/1994 |
| JP | 3247941 | 11/2001 |
| JP | 2004-174582 | 6/2004 |
| WO | WO 02/070173 A1 | 9/2002 |

* cited by examiner

*Primary Examiner*—Scott Kastler
(74) *Attorney, Agent, or Firm*—Oblon, Spivak, McClelland, Maier & Neustadt, P.C.

(57) ABSTRACT

It is an object to form a plate for a sliding nozzle apparatus in a shape for decreasing extreme erosion and extend durability of the plate to enable cost reduction, the sliding-nozzle plate having dimensions (unit length is mm) as indicated in following equations: a dimension from the center position X of the nozzle hole to a closest end of the plate for the sliding nozzle in the longitudinal direction is a sum of a dimension "b" from the center position X to an ideal circle with the position X as the center and a dimension "d" from the ideal circle to the closest end in the longitudinal direction, a dimension from the center position X and to a center position Y is a dimension S of the stroke, and a dimension from the center position Y to a closest end of the plate for the sliding nozzle in the longitudinal direction is a dimension "c", where b: $a$+30~40, c: 0.75$a$+20~30, d:0.5$a$, S:2$a$+m, and m:15~35.

9 Claims, 8 Drawing Sheets

BACKGROUND ART

BACKGROUND ART

NOZZLE PLATE FOR A SLIDING NOZZLE APPARATUS

BACKGROUND OF THE INVENTION

1. Field of the Invention

The present invention relates to a nozzle plate which is attached to a bottom of a container such as a ladle or tundish that accommodates molten steel and mounted on a sliding nozzle apparatus that controls a pouring rate of molten steel or the like, and more particularly, to a sliding nozzle plate to control a pouring rate of molten steel or the like discharged from the nozzle apparatus.

2. Description of Related Art

A sliding nozzle apparatus (hereinafter, also referred to simply as a "nozzle apparatus") is attached to a ladle which receives molten steel discharged from a steel furnace such as a converter to carry, and pours the steel into a mold, or attached to a tundish which receives molten steel from a ladle and pours the molten steel into a mold, and is used widely as a pouring rate adjustment apparatus.

FIG. 6 shows a sliding nozzle apparatus generally used. The nozzle apparatus 141 is comprised of two plates, a fixed plate 121 that engages in a metal frame 153 provided on the bottom of a ladle, and a sliding plate 123 which is in pressure-contact with the lower surface of the fixed plate and is engaged in a metal frame 155 slidably. Hereinafter, the fixed plate and sliding plate are collectively referred to as a slide plate.

In order to prevent molten steel from leaking from a pressure-contact surface between the fixed plate 121 and sliding plate 123, the plates 121 and 123 are provided with a surface pressure mechanism (not shown) which applies a surface pressure in the longitudinal direction from the outside of metal frames 153 and 155. The fixed plate is engaged in the metal frame in a position such that a nozzle hole 3 is aligned with a nozzle hole 171 of an upper nozzle 143 disposed on the bottom of the ladle or the like. The sliding plate 123 is provided with a nozzle hole 5 corresponding to the fixed nozzle hole 3, and is slid to adjust an opening degree of the nozzle holes. The metal frame in which the sliding plate is engaged is coupled to the nozzle apparatus, for example, in a pin joint 153 at its end portion, and is slid by a hydraulic cylinder or the like in remote control through an operation rod 159.

The leak of molten steel occurs when respective nozzle holes of the fixed plate and sliding plate are in partly-open positions, while occurring hardly in full-closed positions. Only required are the function that controls a passage flow rate of the molten steel in the half-open positions and the function that simply stops the flow of the molten steel in the full-closed positions. In the partly-open positions, erosion is severe at portions such that the molten steel flow collides with the plate and that the molten steel flow changes its flow direction. Therefore, the fixed plate and sliding plate of the sliding nozzle apparatus have been handled as consumables.

The fixed plate and sliding plates are manufactured using expensive refractory materials, and are improved in shape and structure. For example, as shown in FIG. 12, Japanese Patent No. 3247941 describes an example of the nozzle plate reached from usage examples at portions where erosion is severe in consideration of a ratio of (g-f)/f based on the experiments on the plate. The document as described above disclose a decagon plate for a sliding nozzle provided with a dimension "g" substantially 1.5 times the diameter "f" of a nozzle hole and a dimension "h" substantially three times the diameter "f" of the nozzle hole in the longitudinal direction from the center position "Z" of the nozzle hole.

In the invention of Patent No. 3247941 as described above, since the dimension "g" is substantially 1.5 times the diameter "f" of the nozzle hole, it is understood that the plate 201 for a sliding nozzle has intense erosion and cracks in the nozzle hole in the longitudinal direction and has problems in durability.

FIG. 13 shows a schematic front view of a fixed plate 221 and sliding plate 223 for a sliding nozzle in the longitudinal direction in full open position. Arrows in FIG. 13 indicate pressure-contact directions 229 of the surface pressure mechanism. When the sliding plate is slid from the closed position, a distance "i" is increased between the end surface of the fixed plate 221 and the end surface of the sliding plate 223. At this point, the surface pressure mechanism acts in a portion corresponding to the distance i, but in the portion the sliding plate 223 is not positioned to be in contact. On the other hand, the opposite side (right side as viewed in FIG. 13) of the sliding plate 223 projects from the end of the fixed plate on the upper side, but the surface pressure does not act in this position. This is because the surface pressure mechanism not shown acts on the metal frames 153 and 155, but does not act directly inside of the metal frames.

Therefore, there occurs a deviation of the pressure-contact force of the surface pressure mechanism, and a tilt appears between the fixed plate 221 and sliding plate 223 as shown in FIG. 13. Hence, a gap 225 develops. The gap 25 is maximum when the displacement becomes maximum between the fixed plate 221 and sliding plate 223, i.e. the nozzle holes are full open.

FIG. 14 shows a schematic view of the fixed plate 221 and sliding plate 223 in the transverse direction when the nozzle holes are full open. Arrows in FIG. 14 indicate pressure-contact directions 229 of the surface pressure mechanism. The fixed plate 221 and sliding plate 223 are brought into intimate contact with each other by the pressure contact force of the surface pressure mechanism. The surface pressure mechanism applies the pressure outside the fixed plate 221 and sliding plate 223, the fixed plate 221 and sliding plate 223 thereby arch corresponding to the dimension of width, and therefore a gap 231 develops.

The gaps 225 and 231 have significant effects during casting. For example, during casting of molten steel, air is entangled to promote oxidization of the periphery of the nozzle hole of the plate, thereby causing fierce damage and resulting extremely reduced life.

Cracks generated on the periphery of the nozzle hole will be described below with reference to FIG. 15. As shown in FIG. 15, the nozzle plate is pressed against pressing metal 209 due to thermal expansion of the nozzle plate. For example, when segments of the nozzle plate are formed in the shape of a regular octagon as shown in FIG. 15, a pressing force 207 due to the pressing metal 209 acts toward the center of the nozzle hole 203 as shown by the arrows. Thus, the pressing force 207 gradually causes cracks 205 to occur around the periphery of the nozzle hole 203 having a relatively low strength.

For example, as shown in FIG. 15, the cracks 205 develop in the shape of a cross, and propagate and extend in the plate for a sliding nozzle. When such cracks 205 occur, for example, air is entangled, and oxidization is promoted on the periphery of the nozzle hole of the plate, thereby causing fierce damage and resulting extremely reduced life.

SUMMARY OF THE INVENTION

Accordingly, in view of the issues as described above, it is an object of the present invention to provide a slide plate for a sliding nozzle for overcoming extreme erosion portions due to the shape and the slide plate thereby achieves extended durability and cost reduction.

In order to overcome the issues, an aspect of the present invention is a plate for a sliding nozzle which is attached to a bottom of a container, has a nozzle hole to control a pouring rate, and has dimensions (unit length is mm) as indicated in following equations:

(a) assuming that a diameter of the nozzle hole of the plate for the sliding nozzle is "a", the center position of an upper nozzle hole is X, the center position of a nozzle hole in a position where the nozzle of the plate is fully closed is Y, a stroke of the plate is a dimension S, a safety margin of the stroke is a dimension "m", (b) a dimension from the center position X of the nozzle hole to the closest end of the plate for the sliding nozzle in the longitudinal direction is a sum of a dimension "b" from the center position X to a hypothetical circle with respect to the position X as the center and a dimension "d" from the hypothetical circle to the closest end in the longitudinal direction, and that (c) a dimension from the center position Y of the nozzle hole to the closest end of the plate for the sliding nozzle in the longitudinal direction is a dimension "c", (d) "b", "c", "d", S and "m" have respective following dimensions:

b: a+30~40 c: 0.75a+20~30 d: 0.5a

S: 2a+m m: 15~35.

A second aspect of the present invention is a plate for a sliding nozzle where an outer shape of the plate is in the form of a polygon.

A third aspect of the present invention is a plate for a sliding nozzle where the plate for the sliding nozzle has an outer shape in the form of a polygon obtained by:

(a) assuming that the center portion of the plate is X, the diameter of the nozzle hole is "a" and a regular octagon having as an inscribed circle a hypothetical circle with a radius of "b", (b) connecting end portions of segments of the regular octagon and an end of a segment which is disposed in a position spaced from a segment of one side of the regular octagon by the dimension "d", thereby forming a segment that is part of a polygon; and (c) connecting end portions of the segment that is part of the polygon, end portions of a segment of three sides of a regular octagon having as an inscribed circle a hypothetical circle having a radius of "c", with respect to the center position Y apart from the center position X of the nozzle hole by S as its center and remaining segments of the regular octagon.

A fourth aspect of the present invention is a plate for a sliding nozzle wherein each corner portion of the polygon is formed in the shape of an arc.

A fifth aspect of the present invention is a plate for a sliding nozzle formed in such a manner that a thickness of a portion on the periphery of the nozzle hole is larger than a thickness of the other portion.

The shape of the plate for the sliding nozzle is modified so as to reduce occurrences of a crack and erosion of the holes. As a result, atmospheric air is not entangled, the durability is improved as reduction in erosion, and hence cost reduction is achieved.

DETAILED DESCRIPTION OF THE PREFERRED EMBODIMENTS

Figure 1:
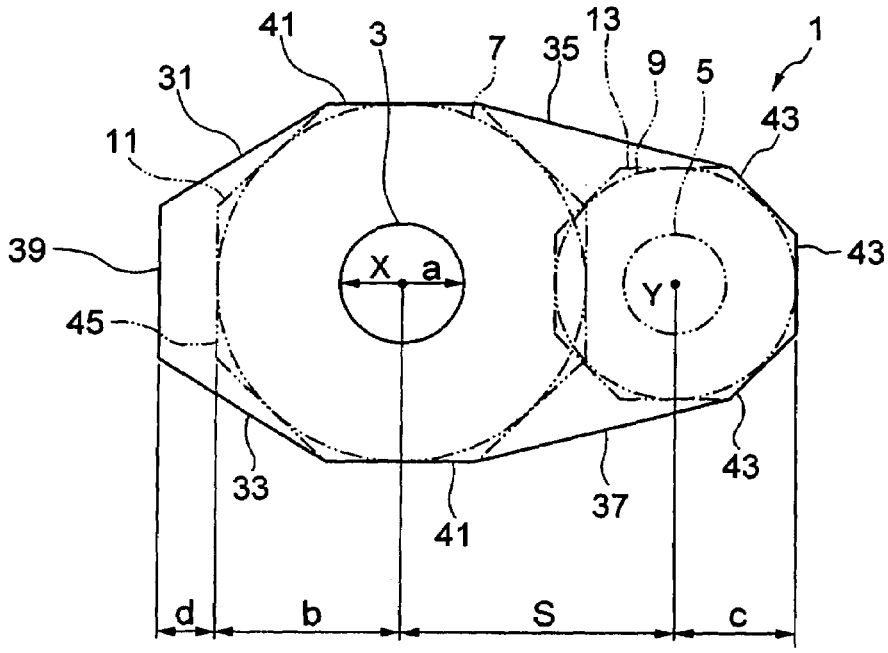
FIG. 1 is a plan view showing a plate for a sliding nozzle in the form of a polygon of the present invention.

The present invention will be specifically described below with reference to accompanying drawings. In FIG. 1, it is assumed that the center of a nozzle hole 3 provided in a polygon plate 1 is defined as a center position X, a diameter of the nozzle hole 3 is defined as "a", a dimension "d" is a distance from a hypothetical circle 7 such that the center of the circle 7 is the nozzle hole center position X and the distance "d" is a distance between the circle and a closest end portion of the polygon plate 1 in the longitudinal direction, Y is a position which is spaced from the nozzle hole center position X by a dimension S (stroke end position) corresponding to a sliding distance of the polygon plate 1 and which is the nozzle hole center position when the nozzle is fully closed for a sliding nozzle, and that a dimension "c" is a distance from the nozzle hole center position Y to a closest end portion of the polygon plate 1 in the longitudinal direction.

Dimensions of the polygon plate 1 are as follows:

The dimension "b" is a sum of the nozzle hole diameter and 30 to 40 mm. The dimension "c" is a sum of the nozzle hole diameter "a" times 0.75 and 20 to 30 mm. The dimension "d" is the nozzle hole diameter "a" times 0.5. The dimension S is a sum of the nozzle hole diameter "a" times 2 and the safety margin "m", where "m" is 15 to 35 mm.

A plate for a sliding nozzle (hereinafter, also referred to as a sliding-nozzle plate) of the present invention is in form of a polygon and has dimensions and shape as described below. An edge segment 39 equal to a segment 45 of a regular octagon 11 with the inscribed circle 7 with the diameter b is provided in a position spaced from the position X by the dimension "b" plus the dimension "d". Straight lines 31 and 33 are provided to connect respective segments 41 that are opposite two sides of the regular octagon 11 and the edge segment 39. Straight lines 35 and 37 are provided to connect segments 41 and segments 43 that are three sides of a regular octagon 13 with an inscribed circle 9 such that the center is the position Y and the radius is the nozzle hole diameter a, and thus, the polygon plate 1 is obtained in the form of a decagon.

The nozzle hole diameter "a" is defined as a dimension as a reference in manufacturing a plate for a sliding nozzle with desired dimensions. For example, the diameter a is set at 40 mm, 60 mm, 80 mm, 100 mm, or other desired dimension.

"b" is the dimension of a sum of the nozzle hole diameter "a" and 30 to 40 mm. When "b" is increased excessively, molten steel does not leak, but the plate becomes large and economical efficiency degrades. When "b" is decreased excessively, the cost of the plate is reduced, but the frequency of leak of molten steel is increased. Therefore, the dimension of "b" is preferably "a"+30 to 40 mm. In addition, a range of 30 to 40 mm is to provide an allowance, because a difference occurs in dimension by performing baking or the like in manufacturing the plate for the sliding nozzle.

"c" is the dimension of a sum of the nozzle hole diameter "a" times 0.75 and 20 to 30 mm. When "c" is increased excessively, molten steel does not leak, but the plate becomes large and economical efficiency degrades. When "c" is decreased excessively, the cost of the plate is reduced, but the frequency of leak of molten steel is increased. Therefore, the dimension "c" is preferably a sum of the nozzle hole diameter "a" times 0.75 and 20 to 30 mm. In addition, a range of 30 to 40 mm is to provide an allowance, because a difference occurs in dimension by performing baking or the like in manufacturing the plate for the sliding nozzle.

Figure 13:
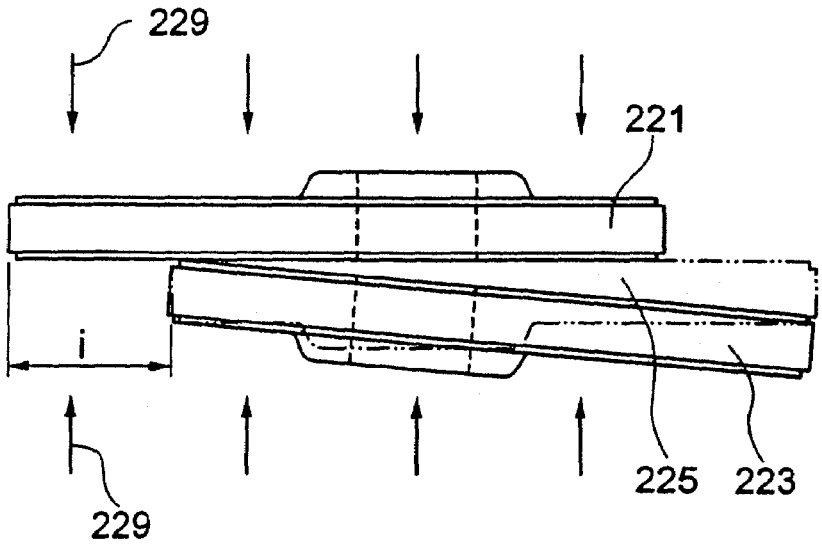
FIG. 13 is a cross sectional view showing a state of development of a gap in a longitudinal direction in the conventional plate for the sliding nozzle.

"d" is the dimension of the nozzle hole diameter a times 0.5. "d" is thus limited by reasons as described below. A case is assumed that a tilt occurs in the plate for the sliding nozzle as shown in FIG. 1 due to application of the surface pressure as shown in FIG. 13. With respect to the dimension in the longitudinal direction of the plate, a case of (b+S+c) and a case of (d+b+S+c) are compared. In the latter case, the dimension is longer by "d" and therefore, a tilt angle is moderate. In other words, the moderated angle decreases a gap, and for example, enables reduced entanglement of air in casting.

Figure 14:
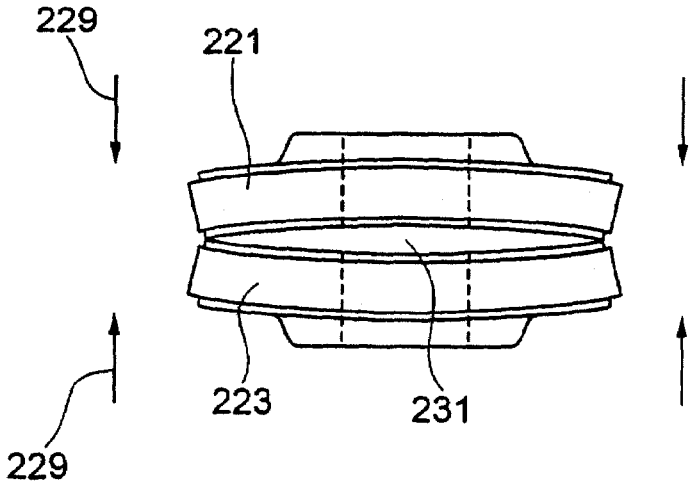
BACKGROUND ART Fig. 14
FIG. 14 is a cross sectional view showing a state of development of a gap in a traverse direction in the conventional plate for the sliding nozzle.

Further, due to the dimension increased by "d" increases, for example, an area of a portion is formed by the edge segment 39 and lines 31 and 33 in the plate for the sliding nozzle. Thus increased area makes the pressure-contact force by the surface pressure mechanism uniform, and increases the strength, and as a result, the arched state as shown in FIG. 14 does not occur. In other words, the gap is decreased, and for example, it is made possible to reduce entanglement of air in casting.

Figure 2:
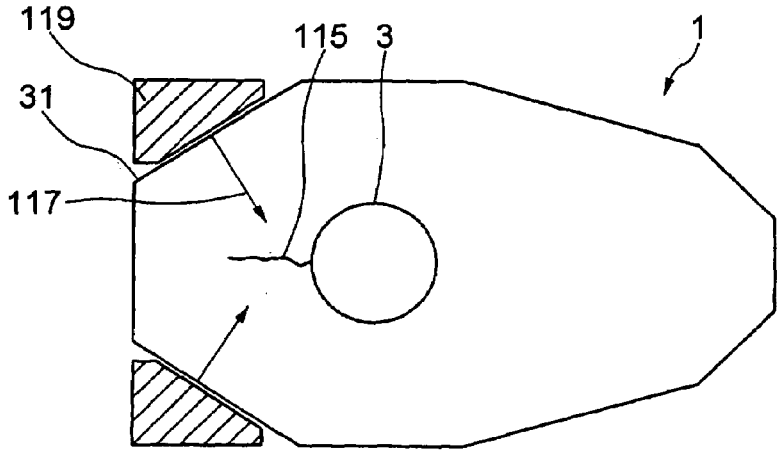
FIG. 2 is a schematic view showing a crack occurring on the periphery of a nozzle hole.
Figure 15:
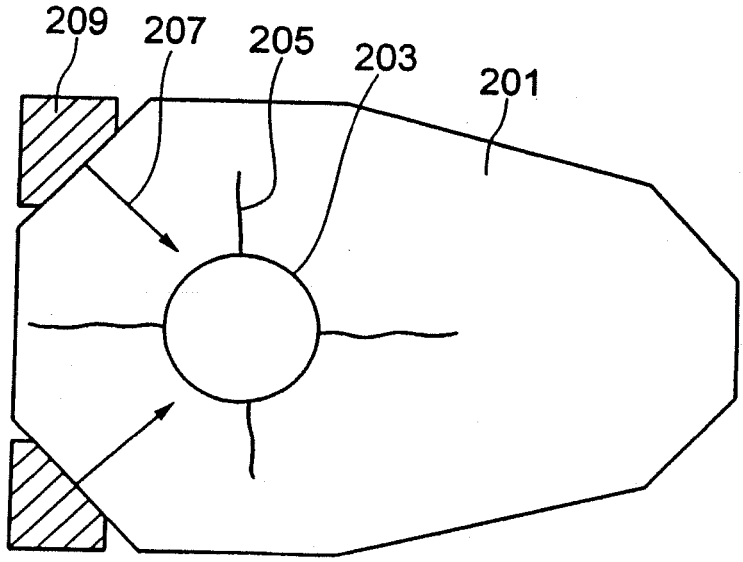
FIG. 15 is a schematic view showing cracks occurring on the periphery of the nozzle hole of the conventional plate for the sliding plate.

A crack developing in the nozzle hole will be described below with reference to FIG. 2. The sliding-nozzle plate 1 is pressed against pressing metal 119 and thus engaged in the metal frame as shown in FIG. 2. However, a pressing force 117 of the pressing metal 119 is not applied toward the center of the nozzle hole 3 as shown by the arrow. Therefore, there is a possibility that a crack occurs on a side where the pressing force 117 acts, but cracks do not occur in directions of a cross from the periphery of the nozzle hole 3, and propagate and extend in the sliding-nozzle plate. In this respect, development of crack is different from that in the conventional plates as described with reference to FIG. 15.

Figure 3:
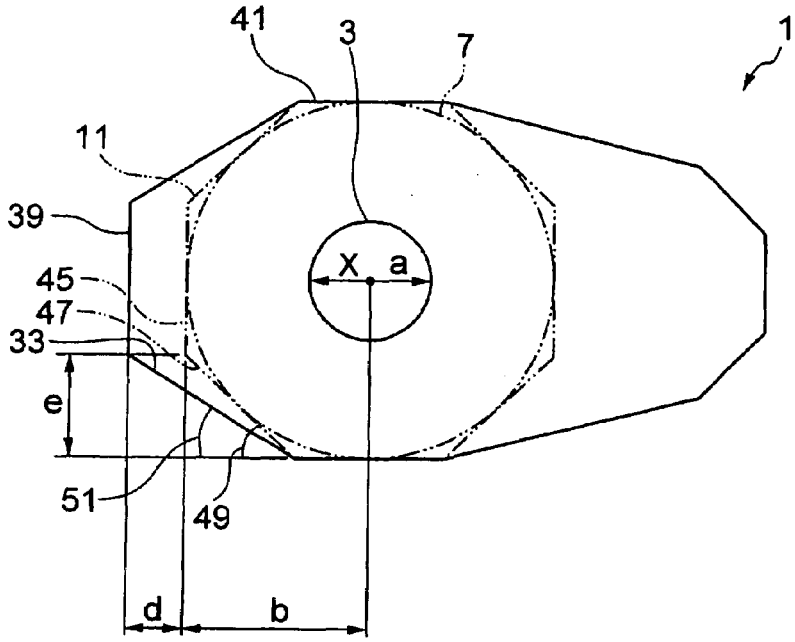
FIG. 3 is a view for illustrating a dimension difference due to a difference in angle of a side of the plate for the sliding nozzle.

Further descriptions are given below with reference to FIG. 3. Compared are an angle 49 of a right triangle provided with the segment 47 and the dimension "e" with an angle 51 of a right triangle provided with the segment 33 and the dimension "e". The angle 51 is moderated of the latter right triangle provided with a side increased by the dimension "d". The angle varies with the dimension "d". When the dimension "d" is increased and the angle is further moderated, since the above-mentioned advantage is enhanced but the cost is increased, the dimension "d" is limited. Therefore, the dimension "d" is preferably the nozzle hole diameter "a" times 0.5.

The stroke S is the dimension of a sum of the nozzle hole diameter "a" times 2 and the safety margin "m". In other words, a travel dimension of the plate is made twice as long as the nozzle hole diameter "a" at minimum. The safety margin "m" is to secure a stroke range for the plate to reliably operate, and is preferably in a range of 15 to 35 mm. The range of 15 to 35 mm is to provide an allowance because a dimension difference occurs due to baking, etc in manufacturing the sliding-nozzle plate. When S exceeds 35 mm, the plate becomes large and the cost is increased. Meanwhile, when S is less than 15 mm, the safety is not ensured.

Figure 4:
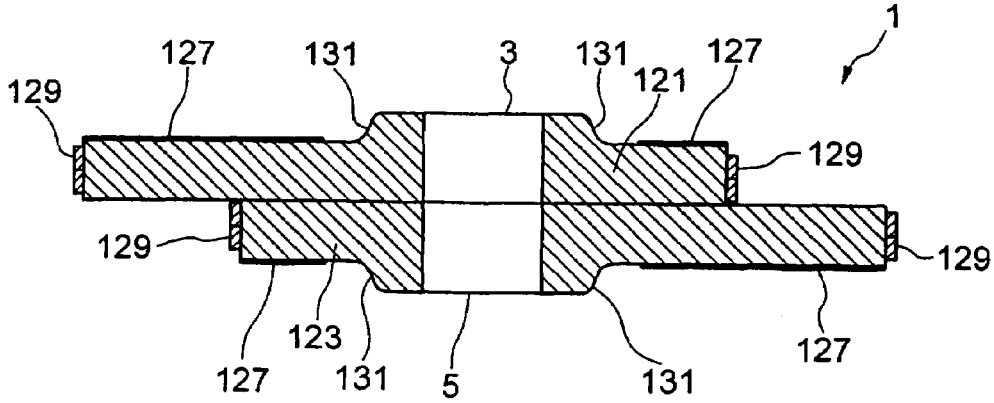
FIG. 4 is a cross sectional view of the plate for the sliding nozzle in a full-open state of the present invention.
Figure 5:
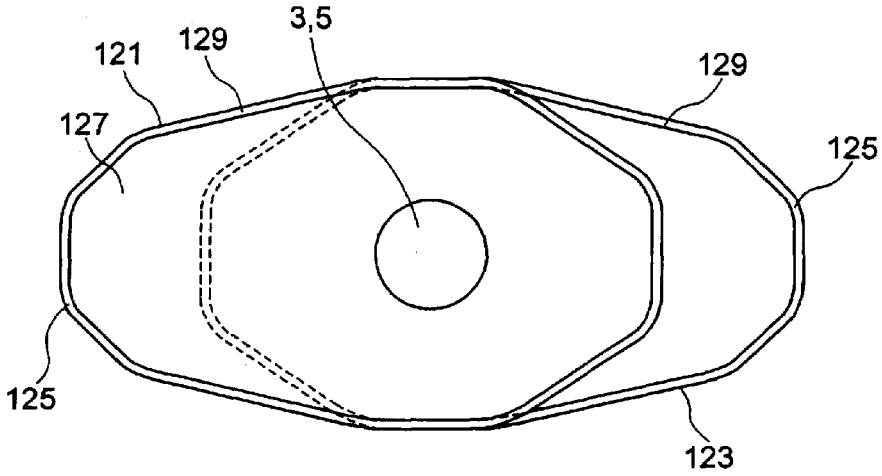
FIG. 5 is a plan view of the plate for the sliding nozzle in the full-open state of the present invention.

FIG. 4 and FIG. 5 show schematic views each of the fixed plate 121 and sliding plate 123 according to the present invention in a position where the nozzle hole positions are aligned.

In the present invention, since the fixed plate 121 and sliding plate 123 can be used mutually, it is preferable that the plates 121 and 123 are formed in the same shape. However, the plates 121 and 123 do not need to be limited to the same shape.

Further, an appearance shape of each of the fixed plate 121 and sliding plate 123 is in the form of a decagon, but may be any shape in a range that enables the plate to be fixed, or each of the vertices of the polygon may be replaced with an arc 125.

Furthermore, thicknesses of the fixed plate 121 and sliding plate 123 are substantially constant, but a plate thickness of a nozzle-hole peripheral portion 131 may be thicker than the other portions. As a result, nozzle holes 3 and 5 are enforced, and engagement in an upper nozzle 143 and a lower nozzle 145 is facilitated, resulting a structure enabling easy detachable.

In addition, in order to make sliding smooth, maintain the intimate contact, and prevent the leak, it may be possible to paste a sheet-shaped thin plate 127 formed of a ceramic sheet or aluminum sheet on one side of the polygon plate 1. Further, in order to prevent occurrences of deformation and crack of the polygon plate 1 due to high temperature, the outside is fastened with a metal band 129 in the form of a band. Thus prepared fixed plate 121 and sliding plate 123 are placed in respective arrangement positions in the sliding nozzle apparatus.

Referring to FIGS. 6 to 9, an example will be described below where the fixed plate 121 and sliding plate 123 are attached to the sliding nozzle apparatus 141.

Figure 6:
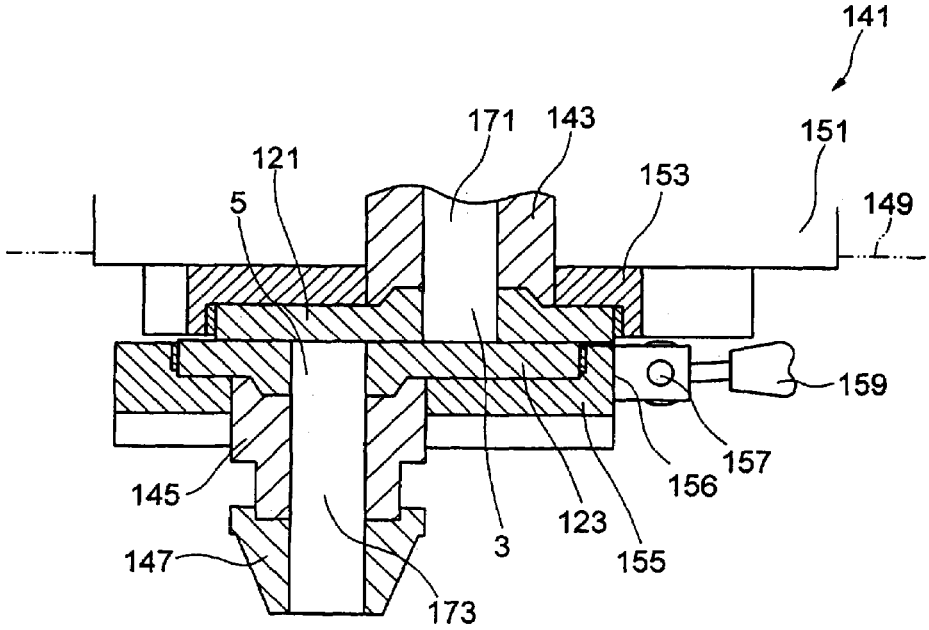
FIG. 6 is a cross sectional view of the plate for the sliding nozzle in a full-closed state attached to the sliding nozzle apparatus of the present invention.

FIG. 6 shows a case where the nozzle plate is closed. The upper nozzle 143 is attacked on a bottom 151 of a ladle 149, and provided with a nozzle hole 171. The fixed plate 121 is, in a position where nozzle holes 171 and 3 are aligned, engaged in a fixed metal frame 153 provided in the form of an inverse-concave with substantially the same shape as that of the plate 121.

The sliding plate 123 is engaged in a sliding metal frame 155 provided in the form of a concave with substantially the same shape as that of the sliding plate, in a position where a nozzle hole 5, the lower nozzle 145 and a nozzle hole 173 of a join 147 are aligned. An end portion 156 of the sliding metal frame 155 is coupled to a pin join 157 and is slid in the horizontal direction as viewed in the figure by a remote operation rod 159.

Figure 7:
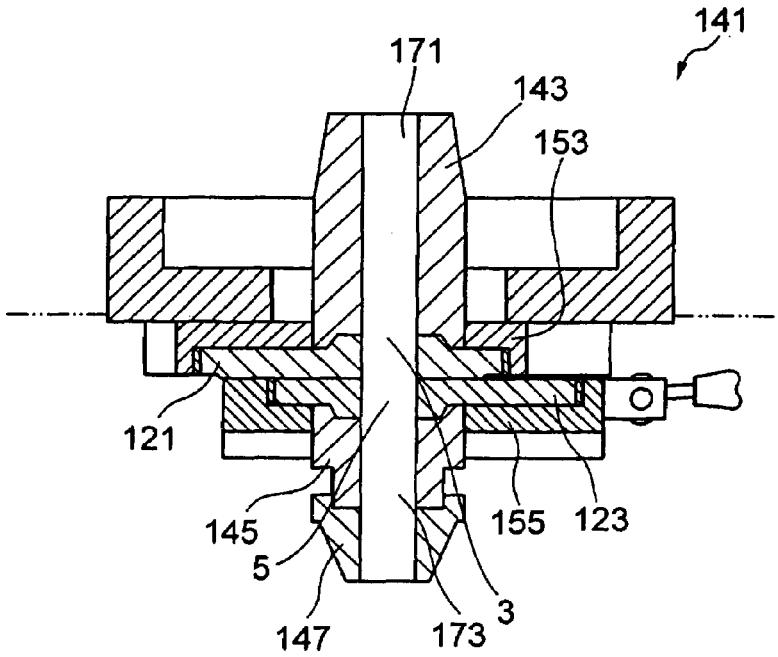
FIG. 7 is a cross sectional view of the plate for the sliding nozzle in a full-open state attached to the sliding nozzle apparatus of the present invention.

FIG. 7 shows a schematic view of the fixed plate 121 and sliding plate 123 in a full-open position. In a full-open position of nozzle holes 3 and 5 of the nozzle plate of the sliding nozzle apparatus 141, the nozzle hole 3 of the fixed plate 121 and the nozzle hole 5 of the sliding plate 123 are aligned with each other. Therefore, it is possible to flow molten steel from a ladle to a tundish or the like in a state where the flow-rate resistance is low. Accordingly, each portion undergoes little damage due to the flow rate of molten steel. However, the gap between the fixed plate and sliding plate is almost maximum in this position, and there is a possibility that air is entangled from the gap and the nozzle-peripheral portion undergoes damage, but the damage is a little because of using the sliding-nozzle plate of the present invention.

Figure 8:
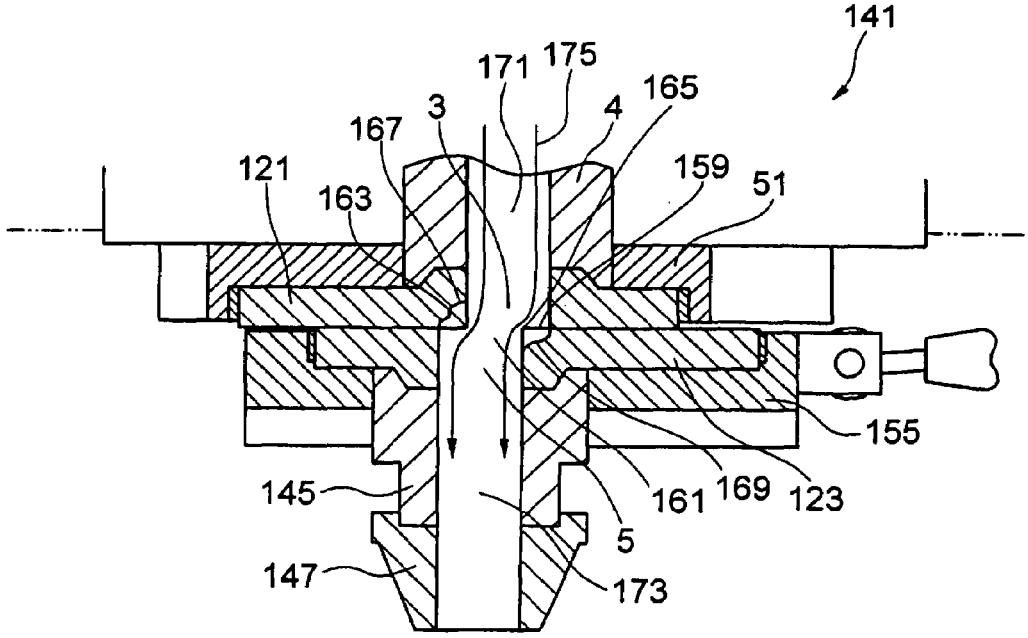
FIG. 8 is a cross sectional view of the plate for the sliding nozzle in a half-open state attached to the sliding nozzle apparatus of the present invention.

FIG. 8 shows a schematic view of the fixed plate 121 and sliding plate 123 in a half-open position. When the sliding plate 123 is slid, the nozzle hole 5 of the sliding nozzle 123 shifts leftward as viewed in the figure with respect to the nozzle hole 3 of the fixed plate 21, and the nozzle hole 3 starts closing. A molten steel flow 175 as shown by the arrow collides with a closed portion of the sliding plate 123, changes its direction, and moves toward an opening portion 161 of the nozzle hole 5 of the sliding nozzle 123.

A molten steel flow 171 is determined by the opening portion 161 of the nozzle holes 3 and 5, and increases its speed at the opening portion 161. Molten steel flows 175 bend in the direction of an end portion 163 of the fixed plate 121 and of an end portion 165 of the sliding plate 123, as shown by the arrows. Such flows provide the end portion 163 of the fixed plate 121 with damage of an eroded portion 167 substantially in the form of an arc, while providing the end portion 165 of the sliding plate 121 with damage of an eroded portion 169 substantially in the form of an arc.

Figure 9:
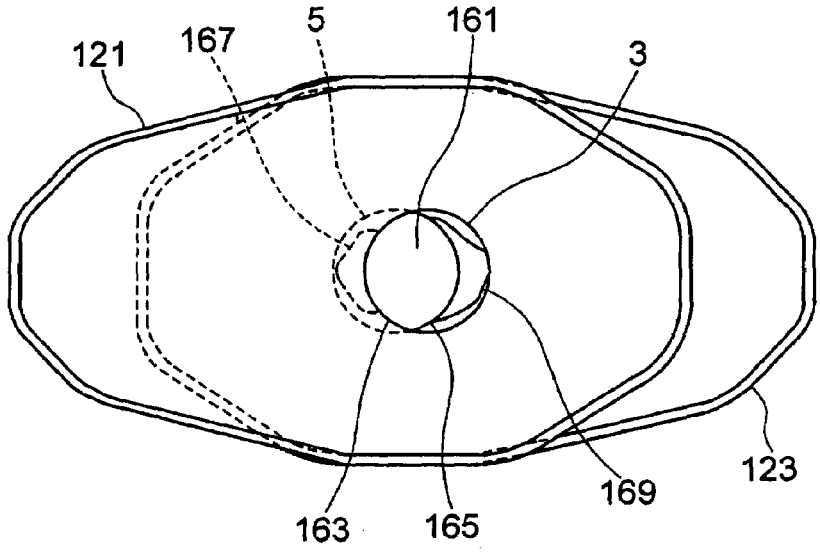
FIG. 9 is a plan view of the plate for the sliding nozzle in the half-open state attached to the sliding nozzle apparatus of the present invention.

FIG. 9 shows a schematic view of a status of the fixed plate 121, a sliding state of the sliding plate 123 and an eroded portion. Such a status shows that the sliding plate 123 is pressed against and in contact with fixed plate 121 and the nozzle holes 3 and 5 are in a half-open position. An eroded portion occurs easier in the portion 169 of the sliding plate 123, and is formed in the shape of an arc gradually depending on sliding.

When air is sucked from the gap of a sliding-nozzle plate, heat by oxidation of the molten steel further increases the erosion portion, but using the sliding-nozzle plate of the present invention decreases the erosion portion. Further, cracks developing from the periphery of the nozzle hardly occur.

Figure 10:
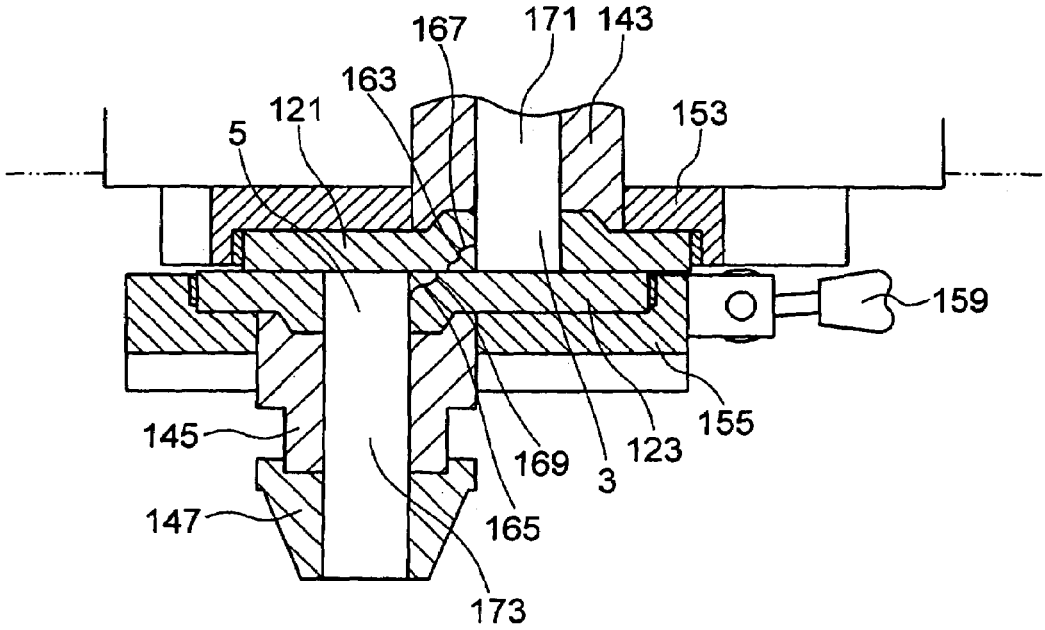
FIG. 10 is a cross sectional view of the plate for the sliding nozzle in a full-closed state attached to the sliding nozzle apparatus of the present invention.

FIG. 10 shows a schematic view of a status where the fixed plate 121 and sliding plate 123 are in a full-closed state after the half-open state as shown in FIGS. 6 and 7. The nozzle hole 5 of the sliding plate 123 is enclosed and thus closed completely, whereby the molten steel is interrupted. The leak of the molten steel is affected by the surface pressure apparatus of the sliding plate 123.

Figure 11:
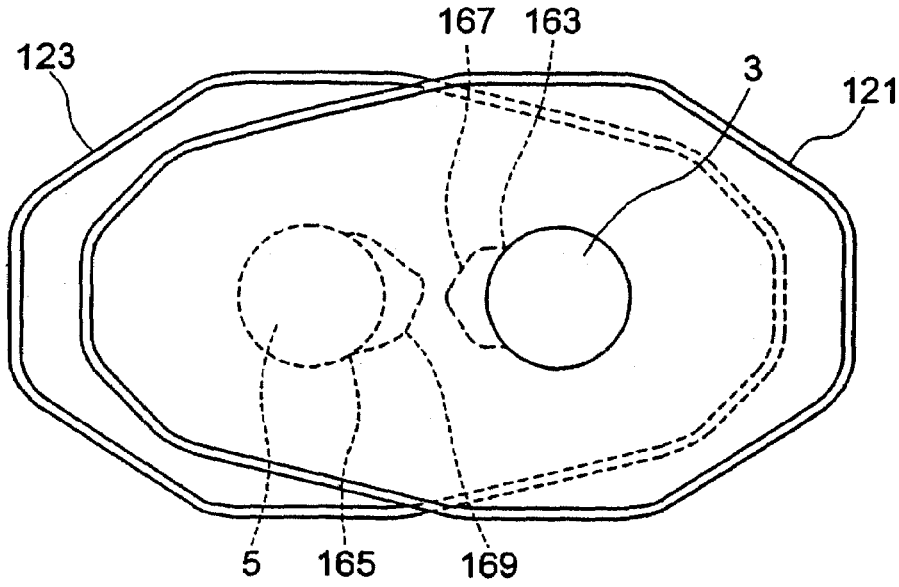
FIG. 11 is a plan view of the plate for the sliding nozzle in the full-closed state attached to the sliding nozzle apparatus of the present invention.
Figure 12:
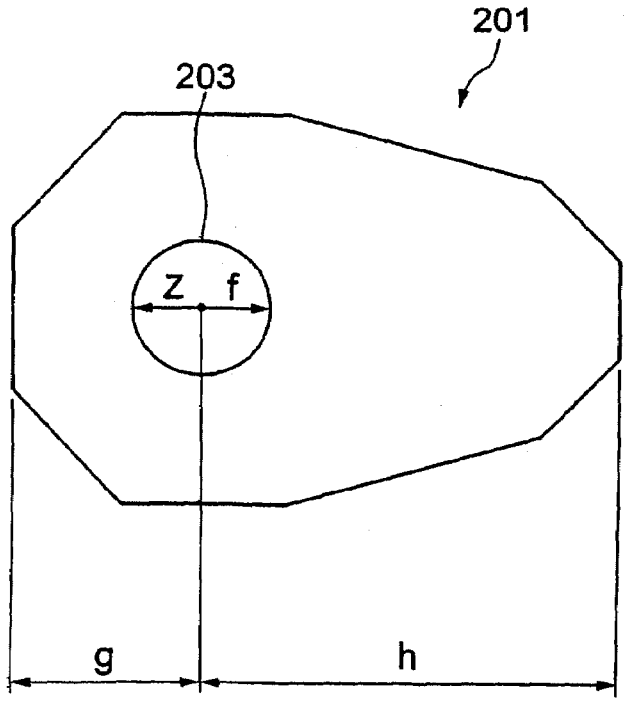
FIG. 12 is a plan view showing a conventional plate for a sliding nozzle.

FIG. 11 shows a schematic view of the status of the fixed plate 121, a sliding status of the sliding plate 123 and a state of erosion as shown in FIG. 10. As the erosion proceeds, the nozzle-hole erosion portion 167 of the fixed plate 121 is almost brought into contact with the nozzle-hole erosion 169 of the sliding plate 123, reaching the time for exchanging the sliding-nozzle plate.

EXAMPLE 1

An example of the plate for a sliding nozzle as described in the above was manufactured. Each dimension was as follows: the dimension "a" was 80 mm, the dimension "b" was 120 mm, the dimension "c" was 80 mm, the dimension "d" was 40 mm, the dimension "m" was 20 mm, and the dimension S was 180 mm. The plate was formed in the shape of a decagon with a thickness of 40 mm. The thickness of the periphery of the nozzle hole was 60 mm. Each corner was rounded. Further, a thin plate of a ceramic sheet was bonded on one side, and side surfaces were fastened by a steel band. As a result, cracks hardly occurred as compared to the conventional product. When the plates were attached to a sliding nozzle apparatus of a 300-ton ladle, the number of usage times was increased from 4 to 6 times.

What is claimed is:

1. A sliding-nozzle plate for a sliding nozzle apparatus which is attached to a bottom of a container to control a pouring rate, comprising a plate with the following dimensions: (unit length is mm)

(a) assuming that a diameter of a nozzle hole of the sliding-nozzle plate is "a", the center position of an upper nozzle hole is X, the center position of a nozzle hole in a position where the nozzle of the plate is fully closed is Y, a stroke of the plate is a dimension S, a safety margin of the stroke is a dimension "m", (b) a dimension from the center position X of the nozzle hole to the closest end of the sliding-nozzle plate in the longitudinal direction is a sum of a dimension "b" from the center position X to a hypothetical circle, which is inscribed within a hypothetical regular octagon having two opposite parallel segments defined by two edges of the sliding-nozzle plate parallel to the longitudinal direction, with the position X as the center and a dimension "d" from the hypothetical circle to the closest end in the longitudinal direction, and that (c) a dimension from the center position Y to the closest end of the sliding-nozzle plate in the longitudinal direction is a dimension "c", and (d) "b", "c", "d", S and "m" have respective following dimensions:

b: a+30~40 c: 0.75a+20~30 d: 0.5a

S: 2a+m m: 15~35.

2. The sliding-nozzle plate according to claim 1, wherein an outer shape of the plate is in the form of a polygon.

3. The sliding-nozzle plate according to claim 1, wherein the plate has an outer shape in the form of a polygon obtained by:

(a) assuming that the diameter of the nozzle hole is "a" and the first regular octagon having as an inscribed circle the first hypothetical circle with the center position of X of the nozzle hole as its center and with a radius of"b", (b) connecting end portions of segments of the first regular octagon and end portions of a segment which is disposed in a position spaced from a segment of one side of the first regular octagon by the dimension "d" and has the same dimension as the dimension of the segment of the polygon, thereby forming a segment that is part of the polygon; and (c) connecting end portions of the segment that is part of the polygon, end portions of segments of three sides of a second regular octagon having as an inscribed circle a second hypothetical circle with the position Y apart from the center position X of the nozzle hole by a distance S as its center and with a radius of "c", and remaining segments of the first regular octagon.

4. The sliding-nozzle plate according to claim 2, wherein each corner portion of the polygon has a shape of an arc.

5. The sliding-nozzle plate according to claim 1, wherein a thickness of a portion on the periphery of the nozzle hole is larger than a thickness of another portion of the sliding-nozzle plate.

6. A sliding-nozzle plate according to claim 2, wherein the plate has an outer shape in the form of a polygon comprising:

(a) a nominal nozzle hole in the sliding nozzle plate with a diameter "a", dimensioned such that a first regular octagon has as an inscribed circle a first hypothetical circle with a same center position X as the nozzle hole, said first hypothetical circle having a radius of "b", wherein (b) end portions of segments of the first regular octagon and end portions of a segment, which is disposed in a position spaced from a segment of one side of the first regular octagon by the dimension "d" and has the same length as a length of the segment of the first regular polygon, are connected, thereby forming a segment that is part of the polygon, and (c) end portions of the segment that is part of the polygon, end portions of segments of three sides of a second regular octagon having as an inscribed circle a second hypothetical circle with a center position Y, which center position Y is displaced from the center position X of the nozzle hole by a distance S, said second hypothetical circle having a radius of "c", and remaining segments of the first regular octagon are connected, thus forming the perimeter of the polygon.

7. A sliding-nozzle plate for a slide nozzle apparatus which is attached to a bottom of a container to control a pouring rate, wherein said sliding nozzle plate has an outer shape in the form of the polygon comprising:

(a) a nominal nozzle hole in the sliding nozzle plate with a diameter "a", dimensioned such that a first regular octagon having as an inscribed circle a first hypothetical circle with a same center position X as the nozzle hole, said first hypothetical circle having a radius of "b", wherein (b) end portions of segments of the first regular octagon and end portions of a segment, which is disposed in a position spaced from a segment of one side of the first regular octagon by the dimension "d" and has the same length as a length of the segment of the first regular polygon, are connected, thereby forming a segment that is part of the polygon, and (c) end portions of the segment that is part of the polygon, end portions of segments of three sides of a second regular octagon having as an inscribed circle a second hypothetical circle with a center position Y, which center position Y is displaced from the center position X of the nozzle hole by a distance S, said second hypothetical circle having a radius of "c", and remaining segments of the first regular octagon are connected, thus forming the perimeter of the polygon.

8. A sliding-nozzle plate for a slide nozzle apparatus according to claim 7, wherein each corner portion of the polygon has a shape of an arc.

9. A sliding-nozzle plate according claim 8, wherein a thickness of a portion on the periphery of the nozzle hole is larger than a thickness of another portion of the sliding nozzle plate.

* * * * *